United States Patent [19]

Ryan

[11] 4,245,589

[45] Jan. 20, 1981

[54] EXOTHERMIC INJECTOR ADAPTER

[76] Inventor: Joseph C. Ryan, 91-045 Hailipo St., Ewa Beach, Hi. 96706

[21] Appl. No.: 925,836

[22] Filed: Jul. 18, 1978

Related U.S. Application Data

[63] Continuation-in-part of Ser. No. 736,873, Oct. 29, 1976, abandoned.

[51] Int. Cl.[2] ..... F02B 3/02

[52] U.S. Cl. ..... 123/298; 432/72; 123/445

[58] Field of Search ..... 123/32 AH, 32 JV, DIG. 7, 123/30, 30 R, 32 J, 122 E, 34 A; 60/39.822; 432/72; 431/268, 347, 191 A

[56] References Cited

U.S. PATENT DOCUMENTS

| | | | |
|---|---|---|---|
| 1,223,124 | 4/1917 | Thompson | 123/30 |
| 2,658,742 | 11/1953 | Suter et al. | 432/72 |
| 3,648,669 | 3/1972 | Rank | 123/32 AH |
| 4,104,992 | 8/1978 | Fricker | 123/32 JV |
| 4,147,142 | 4/1979 | Little | 123/122 E |

*Primary Examiner*—Charles J. Myhre
*Assistant Examiner*—Raymond A. Nelli
*Attorney, Agent, or Firm*—George W. T. Loo

[57] ABSTRACT

An exothermic injector adapter that allows a light weight gasoline engine to operate with the efficiency of a diesel engine. The adapter includes a body, a ceramic sleeve, a retainer, ground wires, power supply wires and a catalytic deflector. The adapter is used with any type of diesel fuel injector to replace the spark plug. It utilizes a heated catalytic deflector in close proximity to the outlet of a fuel injector to ignite the fuel charge efficiently. The catalyst used is exothermic or heat producing under certain conditions and has the ability to fracture the heavy and complex hydrocarbon molecules found in most automotive and diesel fuels. The catalyst is plated to the deflector in a porous configuration so that it has colloidal sized crystals. The catalytic deflector is electrically preheated to its level of exothermic activity. Hydrocarbon fuels break into smaller components upon contacting, the catalytic deflector to create additional heat, which obviates the need for further electrical heating during the operation of the engine.

5 Claims, 3 Drawing Figures

EXOTHERMIC INJECTOR ADAPTER

This application is a continuation-in-part of application Ser. No. 736,873, filed Oct. 29, 1976, entitled Exothermic Injector Adapter now abandoned.

BACKGROUND OF THE INVENTION

1. Field of Invention

This invention relates generally to internal combustion piston engines. It relates particularly to fuel injectors and igniters.

2. Description of the Prior Art

Fuel injector for internal combustion engines utilizes an electrically heated element to ignite fuel in a combustion chamber. No fuel injector or adapter thereto utilizes an exothermic catalyst to ignite the fuel until my invention.

3. Prior Art Statement

Thompson, U.S. Pat. No. 1,223,124, dated Apr. 17, 1917, and Rank, U.S. Pat. No. 3,648,669, dated Mar. 14, 1972, each discloses a fuel injector for internal combustion engines which utilizes an electrically heated element to ignite fuel in a combustion chamber.

Lemale, U.S. Pat. No. 799,856, dated Sept. 19, 1905, teaches the use of a platinum wire in an internal combustion turbo motor. Tartrais, U.S. Pat. No. 1,463,855, dated Aug. 7, 1923, teaches the use of an ignition device with a platinum-iridium filament for initial ignition. Anderson, U.S. Pat. No. 3,085,402, dated Apr. 16, 1963, teaches the use of platinum or platinum alloy wire screen in a re-igniter for internal combustion engines. Suter et al, U.S. Pat. No. 2,658,742, dated Nov. 10, 1953, teaches the use of platinum or palladium as a catalyst on a base of heat and electrically resistant metal to oxidize hydrocarbon vapors.

The differences between my invention and the above cited prior art are such that it would not be obvious to a person skilled in the internal combustion art. There is no teaching in the prior art of the use of an exothermic catalyst in a fuel injector adapter for internal combustion engines. Three conditions must be met to achieve exothermic fractionation of a hydrocarbon fuel in the absence of an oxidizer: (1) High temperature, (2) high pressure, and (3) most important a colloidal or porous platinum surface.

SUMMARY OF THE INVENTION

This invention relates to an exothermic injector adapter that allows a light weight gasoline engine to operate with the efficiency of a diesel engine. The adapter is used with any type of diesel fuel injector to replace the spark plug. It utilizes a heated catalytic deflector in close proximity to the outlet of a fuel injector to ignite the fuel charge efficiently. The catalyst is plated to the deflector in a porous configuration so that it has colloidal sized crystals.

An object of this invention is to provide an exothermic injector adapter that allows a light weight gasoline engine to operate with the efficiency of a diesel engine.

Another object of this invention is to provide an exothermic injector adapter that will convert a gasoline engine to a diesel-type operation.

A further object of this invention is to provide an exothermic injector adapter which will ignite fuel while it is being introduced into the combustion chamber of an engine.

Still another object of this invention is to provide an exothermic injector adapter which will replace the spark plug in a gasoline engine and which will improve its combustion.

A still further object of this invention is to provide an exothermic injector adapter to convert present day gasoline engines to diesel type efficiency without disadvantages of the diesel.

Another object of this invention is to provide an exothermic injector adapter for a gasoline engine which will allow the engine to use kerosene instead of gasoline.

Still another object of this invention is to provide an exothermic injector adapter with a catalytic deflector.

A further object of this invention is to provide an exothermic injector adapter which uses a catalyst that is heat producing under certain conditions and is able to fracture the hydrocarbon molecules found in most automotive and diesel fuels.

A still further object of this invention is to provide an exothermic injector adapter which may be used on any type of engines, including the two cycle, the four cycle and the Wankel.

Another object of this invention is to provide an injector engine with a high power to weight ratio and with a low pollution production capability.

Other objects, features and advantages of the present invention will be readily apparent from the following detailed description taken in connection with the accompanying drawings.

DESCRIPTION OF THE PREFERRED EMBODIMENT

Before explaining the present invention in detail it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Figure 1:
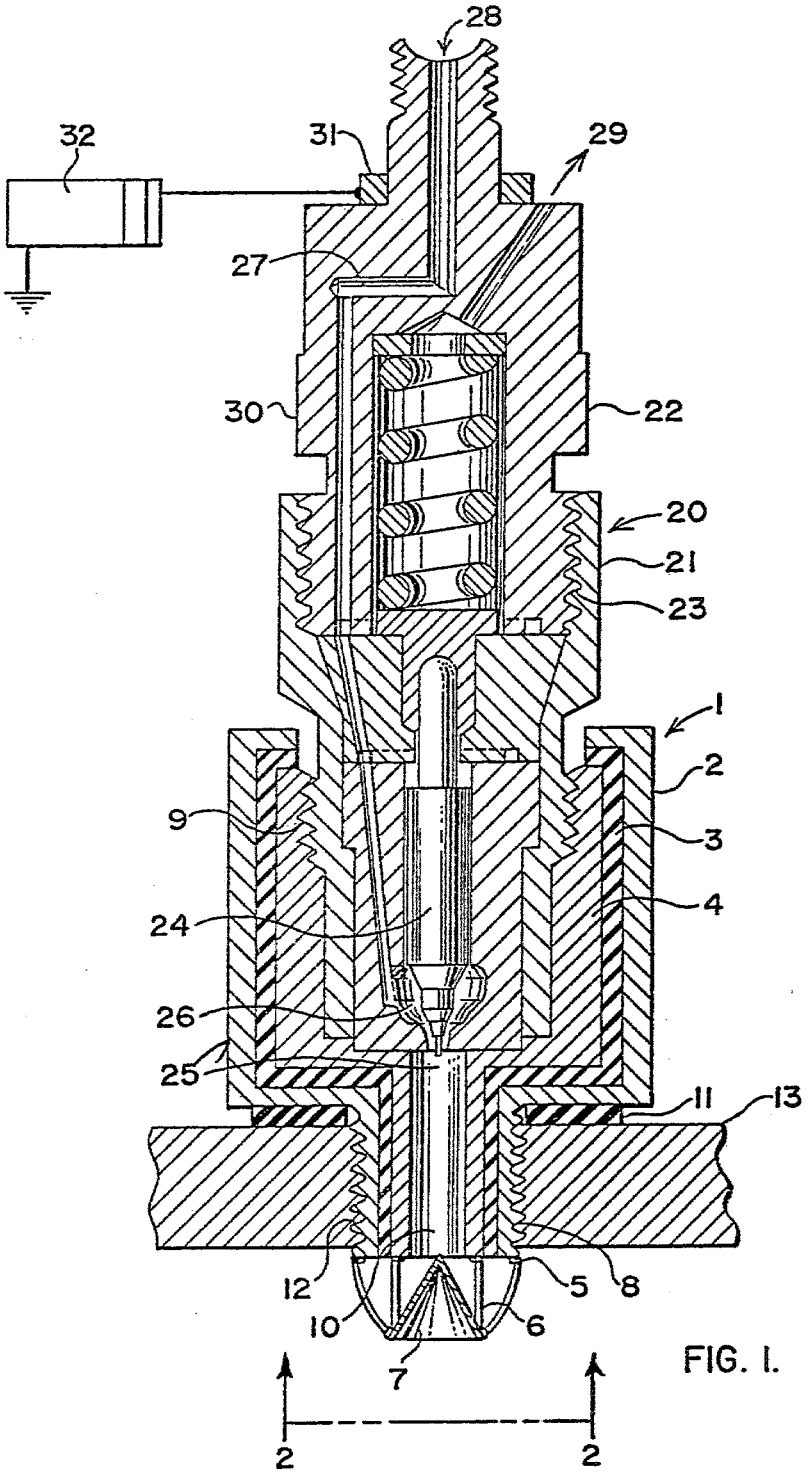
FIG. 1 is a schematic longitudinal cross-section of the exothermic injector adapter, a bosch injector and head of an engine with the adapter connected to a power source.
Figure 2:
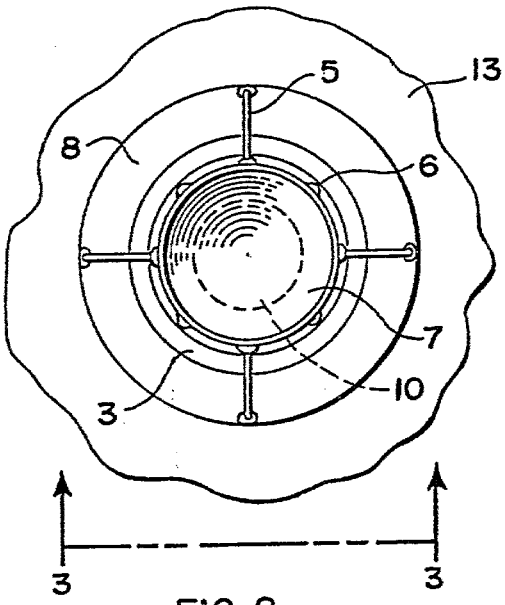
FIG. 2 is an enlarged bottom view of the invention taken on line 2—2 of FIG. 1.
Figure 3:
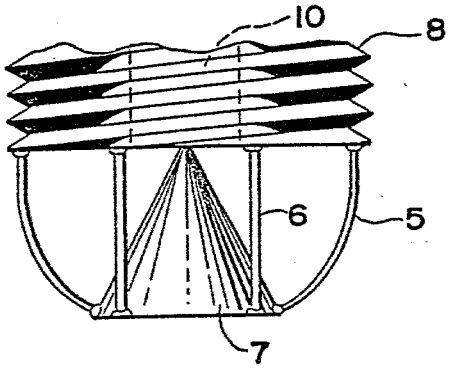
FIG. 3 is an enlarged side view of the invention taken on line 3—3 of FIG. 2.

Referring now to the drawings wherein like reference numerals refer to like and corresponding parts throughout the several views, the preferred embodiment of the invention disclosed in FIGS. 1–3 inclusive is an exothermic injector adapter 1. Exothermic injector adapter 1, hereinafter called adapter, includes a body 2, a ceramic sleeve 3, a retainer 4, four ground wires 5, four power supply wires 6, and a deflector 7. Body 2 has a lower threaded portion 8. Retainer 4 has an internally threaded portion 9 and a cylindrical opening 10.

Adapter 1 is threaded into port 12 of engine head 13 by the interaction of lower threaded portion 8 with the threads of port 12. A head gasket 11 may be used between the adapter 1 and engine head 13. Body 2 may be hexagonally shaped so that a wrench may be applied to it in order to tighten it when it is threaded into port 12.

Injector 20 is threaded into internally threaded portion 9. Injector 20 has an outer member 21, an inner member 22, a fuel valve 24, an outlet orifice 25, a fuel chamber 26, a fuel passage 27, a fuel inlet 28, a fuel return passage 29, and a hex nut 30. Inner member 22 is threaded to outer member 21 at 23.

An electrically conducting gasket 31 is located between fuel inlet 28 and fuel return passage 29. It is connected to a heater power supply 32. The heater power supply can be derived from the starter relay or a relay activated by the engine throttle idle stop.

The catalytic deflector 7 is constructed of a porous metal material, such as found in the iron family. The material is plated with a catalyst in a porous configuration so that the catalyst has colloidal sized crystals. the catalyst used is exothermic or heat producing under certain conditions which are high pressure, high temperature in the presence of porous platinum, and has the ability to fracture the heavy and complex hydrocarbon molecules found in most automotive and diesel fuels in the absence of oxygen.

One end of the power supply wires is resistance welded to the lower edge of the deflector while the other end of power supply wires 6 is welded to retainer 4. One end of ground wires 5 is similarly connected to the lower edge of the deflector and the other end to lower threaded portion 8.

Platinum with colloidal sized crystals is the most desirable catalyst. Normally platinum is endothermic because it has very few active crystal sites. However, platinum with colloidal sized crystals becomes exothermic at 791° F. or higher. When it becomes exothermic, it has the ability to fracture the heavy and complex hydrocarbon molecules found in most automotive and diesel fuels. While colloidal platinum is the most desirable catalytic material because it withstands extreme temperatures and is chemically stable, a cheaper catalytic material might be used if it porous and has similar characteristics.

It is important to distinguish between ordinary platinum and porous or colloidal platinum. Ordinary platinum has very few active crystal sites due to its smooth surface and a small specific surface. Porous or colloidal platinum has many active crystal sites and a large specific surface. The conventional platinum surface does not contain the necessary active crystal junctions for exothermic reactions, whereas porous platinum surface has the necessary active crystal junctions for exothermic reactions.

Similarly the ordinary plating of platinum results in a low specific surface and very few crystal junctions, the apparent and specific surfaces being nearly equal, while platinum plated in a colloidal fashion results in a high specific surface and many crystal junctions.

Porous platinum may be plated to a porous metal material in the following manner: The material is immersed at 180° F. in a solution containing 0.8 gram per liter of platinum chloride and 6 ml. of 37% hydrochloric acid per liter. The solution is agitated gently until the surface of the material is uniformly coated with porous platinum. After plating, the catalyst is rinsed free of soluble materials and heated in the presence of a volatile hydrocarbon to condition the platinum coating for service. The plating is nonreflective and nearly black and has many crystal sites.

At low temperature a platinum crystal is surrounded by a moderately positive electric field. Hydrogen is attracted to its surface and is adsorbed. At a high energy level the platinum crystal is resonating in unity. Electron charges rotate around the atoms of the crystal in unison, creating a rotating or resonating crystal field.

In the positive phase the field of a platinum crystal will attract a bonding electron of the hydrocarbon while the negative field of an adjacent platinum crystal will attract the positive nucleus of the hydrocarbon. In the negative field phase the direct opposite conditions occur. The bonding electron of the hydrocarbon while being repelled from the negative field of a platinum crystal is effectively removed from the carbon atom thereby freeing the hydrogen atom. This is the simplest form of fractionation given as an example only. Molecular weights lower than kerosene would ordinarily result with representations in the alkane, alkene, and alkyne series when kerosene is used as a fuel.

The concept of my catalyst employs the transfer of bonding energy from the nucleus of a fuel molecule and converts it into heat energy at the platinum crystal junctions and elevated temperature of the fractionated fuel. Energy is liberated from the fuel before combustion is initiated. Fuel fractionation and not oxidation is the reason for the close placement of the catalyst to the fuel stream. My catalyst sets up the optimum conditions for combustion before it occurs.

Platinum which is plated in a porous configuration is made up of an open network of crystals of colloidal size. Porous platinum and platinum plated in a colloidal fashion are both identical. They will break down the fuel into basic molecular particles. The small molecular fractions and free carbon and hydrogen produced by the catalyst will insure the most efficient and clean combustion. The products of combustion will show as carbon dioxide and water.

The purpose of the wires or heater grid is to raise the temperature of the catalyst ot its initial level of self sustaining exothermic activity and to ignite the fuel. An ideal porous platinum catalyst would become exothermic at 791° F. However, a catalytic temperature of 1000° F. or higher would be desirable in most cases for a number of reasons. The commercial quality of porous platinum plating is not as rigidly controlled as it would be in a laboratory. Moreover, a platinum catalyst will begin to degrade, wear and erode over a period of time and will take an ever increasing amount of preheat to function as planned. A preheat of 791° F. leaves no margin for any failure.

In use the heater grid raises the temperature of the catalyst to an excess of 1100° F. Once the catalyst becomes exothermic, it will maintain or increase the temperature in an operating engine without the necessity of further electrical heating.

Maintaining adequate catalytic temperatures at idle or low power settings demands a catalytic surface that is highly porous. The porous surface of the deflector allows a small amount of fuel to be retained throughout. Fuel trapped in the pores of the catalyst do not escape immediately but are ejected primarily as hydrogen gas and carbon upon completion of the fuel injection stroke. The trapped fuel also drives the temperature of the catalytic surface to a higher level. This is desirable for maintaining sufficient ignition capabilities at idle and reduced engine power.

The type of catalyst employed and the porosity of the deflector surface each has a bearing on the ability of the deflector to maintain exothermic activity.

For my preferred embodiment the catalytic deflector is a porous platinum plated iron screen. The iron screen has a thickness of 0.020 inches and a screen openings of 25 Microns. The openings are reduced to 5 microns by the porous platinum plating. An iron screen was chosen for the base of my catalyst because iron even in sheet form is porous enough to pass water through its body. The open crystalline structure of iron allows the formation and build up of countless submicroscopic crystals of platinum during its plating. The local resonating electrical fields at these active crystalline sites alternatively attract and expel particles of the fuel molecule creating an ever increasing temperature after the critical temperature of the catalyst has been attained. A porous or colloidal plated iron screen would expose thousands of times the amount of active crystal sites than a common platinum screen.

The exothermic heat of the porous catalytic deflector raises the temperature to a point sufficient to cause ignition of a hydrocarbon after a short electrical preheat. Use of exothermic catalysts eliminate the necessity of electrical power or other heat generating devices to maintain their critical basic operating temperature.

The face angle of the catalytic deflector serves as a fuel mixing device by its action of converting a comparatively dense fuel charge to one that radiates throughout the combustion chamber enabling more complete combustion. Proper deflector angle depends on desired engine speed and combustion chamber design, along with the necessity of reducing flame contact with cylinder heads, walls, and pistons for greater thermal efficiency.

A heater grid and deflector make spray pattern or angle irrelevant inasmuch as the total fuel charge must impinge upon the heater grid prior to ignition. The most common spray patterns are linear single jet, multiple jets and conical forms of many possible angles. Only the form and placement of the deflector must be changed to accommodate the form of the fuel charge.

A catalyst allows a heavier fuel such as kerosene to be burned more thoroughly at a lower pressure and temperature than would occur in a diesel engine. It allows use of kerosene which has desirable lubrication qualities for the high pressure pump and fuel control. The fuel pressure need only be half that which is utilized in the conventional diesel engine.

A gasoline engine can be converted to operate with characteristics very similar to that of the diesel if the fuel injected were ignited while being introduced into the combustion chamber. My invention solves the ignition problem without the necessity of the spark of a gasoline engine or the extreme compression and accompanying bulk and weight of a diesel engine.

A conventional gasoline engine modification would require a fuel pump, a fuel control and diesel injectors to work in conjunction with my adapter. The number of adapters and injectors will coincide with the number of cylinders in the engine. The injectors are modified to lower their operating pressure, while the fuel control is modified to increase the fuel flow.

The modified gasoline engine is basically in a diesel configuration except for the greatly reduced compression ratio and the addition of my adapter for fuel fractionation and ignition. Fuel pressure need only be half that which is utilized in the conventional diesel engine. The engine would have an operating compression ratio of ten to one as optimum. A lower compression ratio is used to ignite a fuel charge and there is more complete burning of the light hydrocarbons produced.

My invention utilizes Bosch pumps, injectors, fuel control (variable displacement pump) throttle system and virtually the entire Bosch diesel system except for the glow plug and precombustion chamber. My invention could be operated in conjunction with Renault, Cummins and G.M.C. diesel as well as other engines presently in production or in service.

A Bosch fuel injector is threaded into my adapter. It emits a spray that is essentially linear. The spray pattern emitted is a tight cone of four degrees radiation.

Two stroke, four stroke and Wankel engines would benefit from the use of my adapter. There would be increased fuel efficiency due to the injected fuel being ignited upon entry into the combustion chamber at high effective compression.

The fuel control and power settings and engine speed determine the amount and timing of the fuel charge. The fuel will be introduced very nearly top dead center at slow engine speed and will progressively advance as the engine speed increases. The fuel control will also delay the delivery of the fuel to the combustion chamber under the condition of increased load.

Prior to engine start, the catalytic deflector is electrically heated to a temperature in excess of 1000° F. so that it is exothermic or heat generating. After temperature in excess of 1000° F. has been attained at the catalytic deflector, the engine is started. After the engine has begun running, the electrical power supply to heat the catalytic deflector is shut off. The heater power supply is derived from the starter relay or a relay activated by the engine throttle idle stop.

Fuel is supplied from a tank, filtered, pressurized, metered and injected in the same manner as a diesel. Fuel is delivered from a tank through a fuel pre-filter to a fuel feed pump, to the main fuel filter, to the fuel control and to the injectors as in a conventional diesel engine. The fuel is injected into the cylinder near the end of the compression stroke in the same manner as the diesel engine. The fuel charge strikes the exothermic catalytic deflector, increases its energy level and fractionates. During the initial contact of the fuel with the catalytic deflector some burning will occur but the majority of the fuel will not ignite because of insufficient oxygen. The major portion of the fuel will ignite after leaving the immediate vicinity of the catalytic deflector as oxygen becomes available. After the fuel has burned any carbon particles remaining on the catalyst, will oxidize, leaving the catalyst chemically clean.

The electric circuit through which the deflector 7 is heated is as follows: Electrical power is introduced from heater power supply 32 through gasket 31. It travels along inner member 22, outer member 21, retainer 4 and power supply wires 6 to deflector 7. From the deflector it travels along ground wires 5 to ground polarity through engine 13 and frame of the vehicle.

Timed fuel charges enter the fuel inlet 28, proceed along the fuel passage 27 to the high pressure chamber 26. The fuel pressure lifts the needle valve 24 from its seat and forces a charge of fuel past the injector outlet orifice 25 and through opening 10, where it is discharged against deflector 7. The spray of injected fuel strikes the heated catalytic deflector 7 causing an additional temperature rise at the catalytic surface as a result of carbon-hydrogen bond disintegration. The temperature increase at the catalytic surface is unrelated to the temperature rise created by oxidation which occurs a slight distance from the deflector. After engine start, electrical power to the catalytic deflector may be removed as the heat supplied by exothermic catalytic action supplies sufficient ignition temperature for engine operation without electrical aid.

Any fuel that escapes from the fuel cavity 26 past the fuel valve 24 and through fuel return passage 29 is returned to the fuel tank in the conventional manner.

The fuel injector 20 is electrically isolated at the fuel inlet 28 by means of a teflon liner (not shown) and at retainer 4 by means of ceramic insulator 3.

Portions of the fuel injector which are subject to high pressure may be plated with the catalyst used for the deflector. The high temperature and pressure in the fuel chamber 26 and the catalyst will initiate conditions favorable to fractionation of the fuel. The fuel will break down into finer molecules upon contact with the deflector. The deflector and injector will have a tendency to remain free of carbon deposits due to the catalyst. Fuel that is chemically broken down unites more easily and thoroughly with oxygen.

My invention has the following advantages over the prior art: (1) Allows a light weight gasoline engine to operate with the efficiency of a diesel engine without the accompanying weight and pressure problems associated with the diesel. (2) The fuel pressure in the pumps and injectors is greatly reduced. (3) Exothermic activity of catalyst is maintained without the use of electrical power. (4) Higher fuel efficiency due to formation of small, easily combustible hydrocarbons. (5) Engine oil will remain relatively uncontaminated for a longer period of time as unburned fuel, carbon particles, lead and ash residue are either eliminated or greatly reduced. (6) Engine size can be reduced below what is now commonly found in automobiles as an injector engine has a high power to weight ratio. (7) Noise level is reduced from that of a diesel as a result of lower compression and combustion pressures.

The use of my adapter in a conventional diesel engine as opposed to the modified gasoline engine would lower the compression ratio required to ignite a fuel charge thus enabling the construction of a lighter and cheaper diesel engine. The diesel would also tend to operate more efficiently due to more complete burning of the light hydrocarbons produced. The fuel pressure need only be eighty percent that which is utilized in the conventional diesel engine. The diesel engine would itself benefit as far as increased efficiency and lighter overall weight. The visible carbon pollutants would be reduced.

Although but a single embodiment of the invention has been disclosed and described herein, it is obvious that many changes may be made in the size, shape, arrangements, color and detail of the various elements of the invention without departing from the scope of the novel concepts of the present invention.

I claim as my invention:

1. A fuel injector adapter for an internal combustion engine comprising a body, an insulator sleeve, a retainer, a heater means and a deflector, said deflector being plated with a catalyst; said body having a longitudinal passage with means at one end of said body adapted for connection to an engine head, said retainer being fixedly located within said longitudinal passage of said body, and having a second longitudinal passage for fuel discharge and means at one end adapted for connection to a fuel injector; said insulator sleeve is located between said body and said retainer; said heater means is located near the discharge end of the longitudinal passage of said retainer; said heater means includes ground wires and power supply wires, one end of said ground wires is connected to the lower edge of said deflector and the other end is connected to said body, one end of said power supply wires is connected to the lower edge of said deflector and the other end is connected to said retainer; said catalyst being exothermic or heat producing under certain conditions which include high temperature and high pressure and having the ability to fracture the heavy and complex hydrocarbon molecules found in most automotive and diesel fuels.

2. The fuel injector adapter of claim 1 in combination with a fuel injector and means for electrically heating said heater means; wherein said catalyst becomes exothermic when it is heated to a temperature in excess of 1000° F.

3. The fuel injector of claim 1, wherein said deflector is conically shaped and is made of a porous metal material; the apex of said deflector faces the discharge end of the longitudinal passage of said retainer.

4. The fuel injector of claim 3, wherein said catalyst becomes exothermic when it is heated to a temperature in excess of 1000° F.

5. The fuel injector of claim 3, wherein said deflector is an iron screen and said catalyst is porous platinum.

* * * * *